US012171279B2

(12) United States Patent
Chen

(10) Patent No.: US 12,171,279 B2
(45) Date of Patent: Dec. 24, 2024

(54) PUSH-UP UNDERWEAR

(71) Applicant: Mingxin Chen, Puning (CN)

(72) Inventor: Mingxin Chen, Puning (CN)

( * ) Notice: Subject to any disclaimer, the term of this patent is extended or adjusted under 35 U.S.C. 154(b) by 0 days.

(21) Appl. No.: 18/751,249

(22) Filed: Jun. 22, 2024

(65) Prior Publication Data

US 2024/0341374 A1 Oct. 17, 2024

(51) Int. Cl.
*A41C 3/14* (2006.01)
*A41C 3/00* (2006.01)

(52) U.S. Cl.
CPC ..... *A41C 3/0028* (2013.01); *A41C 3/144* (2013.01)

(58) Field of Classification Search
CPC ..... A41C 3/0028; A41C 3/144
See application file for complete search history.

(56) References Cited

U.S. PATENT DOCUMENTS 5,157,813 A * 10/1992 Carroll ..... A43C 11/165 36/114
2007/0264905 A1* 11/2007 Horta ..... A41C 3/124 450/41
2010/0175163 A1* 7/2010 Litke ..... F16G 11/12 2/161.4
2013/0203319 A1* 8/2013 Torres ..... A41C 3/0028 450/59
2014/0259301 A1* 9/2014 Berns ..... A43C 9/00 2/336

FOREIGN PATENT DOCUMENTS

CN 219781630 U 10/2023
CN 219920327 U 10/2023
CN 220441945 U 2/2024

* cited by examiner

*Primary Examiner* — Gloria M Hale

(57) ABSTRACT

The present disclosure provides a kind of push-up underwear convenient for regulating cup spacing. The cup is symmetrically and movably set on a underwear, a regulating knob is below the center front of underwear, a regulating rope is in the regulating knob, a regulating rope is in a closed loop state, a rope fixing piece is at a bottom side cup, a cup rim is sewn onto the underwear, elastic fixing edge with narrow side is set at the cup rim, regulating rope is connected with the cup bottom, turning the regulating knob drive the regulating rope to pull the cup for convergence, under the acting force of elastic fixing edge, the cup can reset quickly by turning the regulating knob in the reverse direction, so as to realize the effect of quick regulation, and better wearing experience can be brought about to user.

10 Claims, 9 Drawing Sheets

PUSH-UP UNDERWEAR

TECHNICAL FIELD

This invention involves a kind of push-up underwear that facilitates regulation of cup spacing, and it involves the technical field of underwear.

PRIOR ART

Underwear is an indispensable clothing in the daily life of modern woman, and for better embodying the stature of woman, existing underwear usually has the function of converging, and the effect of converging is realized through the push-up setting of cup, so as to regulate the chest type.

When existing underwear realizes the effect of gathering, the position and spacing of center front are usually regulated, and the bottom and edge of cup are as close as possible, so as to prop and converge breast, so that the chest type is more upright and converged, but since the growth and type change of breast are uncertain, chest type would change when human weight changes, and the chest type of everyone does not fully matches with underwear, one might inevitably feel uncomfortable in wearing to some extent, or optimal wearing effect could not be realized, therefore, adjustable structure is adopted in some existing techniques, and through setting swing arm on the regulating mechanism, the swing arm is connected with cup, when the regulating mechanism is turned, the swing arm is driven to tighten or loosen cup, so as to realize the regulation of cup spacing, so that underwear can be better concretely regulated according to individual circumstance at the time of wearing, and more suitable effect of convergence can be achieved, but existing similar linked structure could only be slowly regulated, since the linkage travel is relatively long, and if in the process of scrubbing and using, the linkage mechanism including swing arm is worn or gets stuck, the regulating effect would be poor or unadjustable to affect the using experience, meanwhile, in the existing regulating mechanisms, since its rotating limit mechanism realizes rotation regulation through pushing the clamping part to retreat by internal tooth, the clamping part would reset to clamp the internal tooth after completion of regulation, so as to realize adjusting fixation, but the clamping part and internal tooth are relatively seriously worn in that kind of structure, the circumstance of failed fastening might occur after long time of use, and user might feel inconvenient because of it.

INVENTION CONTENT

Aimed at the defect or disadvantage in existing technique, this invention is to provide a kind of underwear convenient for regulating cup spacing, by setting elastic fixing edge with narrow side at the cup rim, it is taken as the moving and fixing structure of cup, and regulating knob is set at the position corresponding to the center front of underwear, the regulating rope on the regulating knob is connected with the cup bottom, turning the regulating knob can drive the regulating rope to pull the cup for convergence, and under the acting force of the elastic fixing edge, the cup can reset quickly by turning the regulating knob in the reverse direction, so as to realize the effect of quick regulation, so as to bring about better wearing experience to user.

In order to realize the above aim, the technical scheme adopted in this invention is as follows: it includes underwear 1, cup 2, cup 2 is symmetrically and movably set on underwear 1, there is regulating knob 3 below the corresponding position of center front of underwear 1, there is regulating rope 4 in the regulating knob 3, the regulating rope 4 is in state of closed loop, there is rope fixing piece 5 at the bottom at that side of the cup 2 faced with the regulating knob 3, the regulating rope 4 is fixed onto the rope fixing piece 5, the traction position of the regulating rope 4 is higher than the low point of the arc end at the bottom of cup 2, and the rim of the said cup 2 is sewn onto the underwear 1 through the elastic fixing edge 2-1 with narrow side.

Furthermore, there is isolating pad 6 at the position corresponding to the center front of the said underwear 1, the isolating pad 6 extends to cover bottom of underwear 1, and the regulating knob 3 is sewn onto the isolating pad 6.

Furthermore, there are multiple sewing areas 5-1 on the said rope fixing piece 5, and the sewing areas 5-1 correspond to the regulating rope 4.

Furthermore, the said regulating knob 3 includes fixing baseplate 3-1, winding wheel 3-2, limit shell 3-3 and top cover 3-4, the limit shell 3-3 is fastened with the fixing baseplate 3-1, the winding wheel 3-2 is set into the limit shell 3-3, and the top cover 3-4 is set at the top of the limit shell 3-3, and it is movably connected with the winding wheel 3-2.

Furthermore, the said winding wheel 3-2 includes winding section 3-2-1, limit arm 3-2-2 and chassis 3-2-3, the winding section 3-2-1 is located on the chassis 3-2-3, the limit arm 3-2-2 is a symmetrical structure which is set on the winding section 3-2-1, there is through hole at the center of chassis 3-2-3, there is limiting edge 3-2-31 at the rim of through hole, and the limiting edge 3-2-31 extends inward.

Furthermore, the said limit arm 3-2-2 includes the first limit arm 3-2-21 and the second limit arm 3-2-22, that side of the first arm 3-2-21 opposite to the second limit arm 3-2-22 is an arc structure, fixed groove 3-5 is formed at both ends of the opposite part, the bottom of fixed groove 3-5 extends outward to form spacing plate 3-5-1, the middle part is a through groove that extends to the winding section 3-2-1, there are the first baffle 3-2-211 and the second baffle 3-2-212 on the first limit arm 3-2-21, there are the third baffle 3-2-221 and the fourth baffle 3-2-222 on the second limit arm 3-2-22, the first baffle 3-2-211 and the second baffle 3-2-212 are set obliquely and symmetrically to be opposite, the top part does not contact, the third baffle 3-2-221 and the fourth baffle 3-2-222 are obliquely and symmetrically set to be opposite, the top part does not contact, there is limit clamping slot 3-6 at the top of the said first baffle 3-2-211, the second baffle 3-2-212, the third baffle 3-2-221 and the fourth baffle 3-2-222, and the length of the inner side of the limit clamping slot 3-6 is greater than the length of outer side.

Furthermore, there are the first eyelet, the second eyelet, the third eyelet and the fourth eyelet on the winding section 3-2-1, the first eyelet 3-2-11 penetrates the winding section 3-2-1, and by the central point of the opening direction of the limit arm 3-2-2 as the center of symmetry, it is perpendicular to the limit arm 3-2-2, the second eyelet 3-2-12 is set symmetrically with the first eyelet 3-2-11, by the central point in the opening direction of the fixed groove 3-5 of limit arm 3-2-2 as the center of symmetry, the third eyelet 3-2-13 and the fourth eyelet 3-2-14 are set symmetrically, and the eyelet 3-2-11 and the second eyelet 3-2-12 are set above the third eyelet 3-2-13 and the fourth eyelet 3-2-14.

Furthermore, the said fixing baseplate 3-1 is far from one side of winding wheel 3-2 and extends forward, there is rope traction seat 3-1-1 on the top of the extension segment, and there is traction slot 3-1-2 on the rope traction seat 3-1-1.

Further, there is limit gear 3-3-1 at the top of inner wall of the said limit shell 3-3, and one side of the limit gear 3-3-1 mates with the limit clamping slot 3-6.

Furthermore, there is rotating shaft 3-4-1 on the bottom center of the said top cover 3-4, the rotating shaft 3-4-1 is a symmetrical semi-cylindrical structure, there is limit slot 3-4-11 at the terminal of the rotating shaft 3-4-1, the rotating shaft 3-4-1 penetrates the winding wheel 3-2, it is movably connected with the fixed baseplate 3-1 through the mating of the limit slot 3-4-11 and the limit edge 3-2-31, there is fixed block 3-4-2 at both sides of rotating shaft 3-4-1, the fixed block 3-4-2 matches with the fixed groove 3-5, there are push blocks 3-4-3 that are symmetrically set at both sides of the fixed block 3-4-2, the push block 3-4-3 is set obliquely, and the declivity matches with the limit arm 3-2-2.

After the above technical scheme is adopted, advantageous effect of this invention is: through setting elastically constrained structure at the cup rim, the cup fits better at the time of regulating and wearing, the feeling of comfort is better, and through the regulating mechanism that is set to be high, it directly acts on the bottom rim of cup, the regulating speed is quicker, and the effect of pulling together is more obvious, meanwhile, by means of the regulating mechanism that is controlled bilaterally, not only the feel of regulating is more obvious, but also the regulating and fixing effect is better, so that better using experience is brought about to user.

DRAWING EXPLANATION

In order to more clearly explain the example of this invention or the technical scheme in existing technique, the patent drawing that needs to be used in the example or existing technical description is briefly introduced as follows, it is obvious that the patent drawings described below are only some examples of this invention, and for ordinary technical personnel in this domain, on the prerequisite of not performing creative labor, other patent drawings can be obtained according to these patent drawings.

Figure 1:
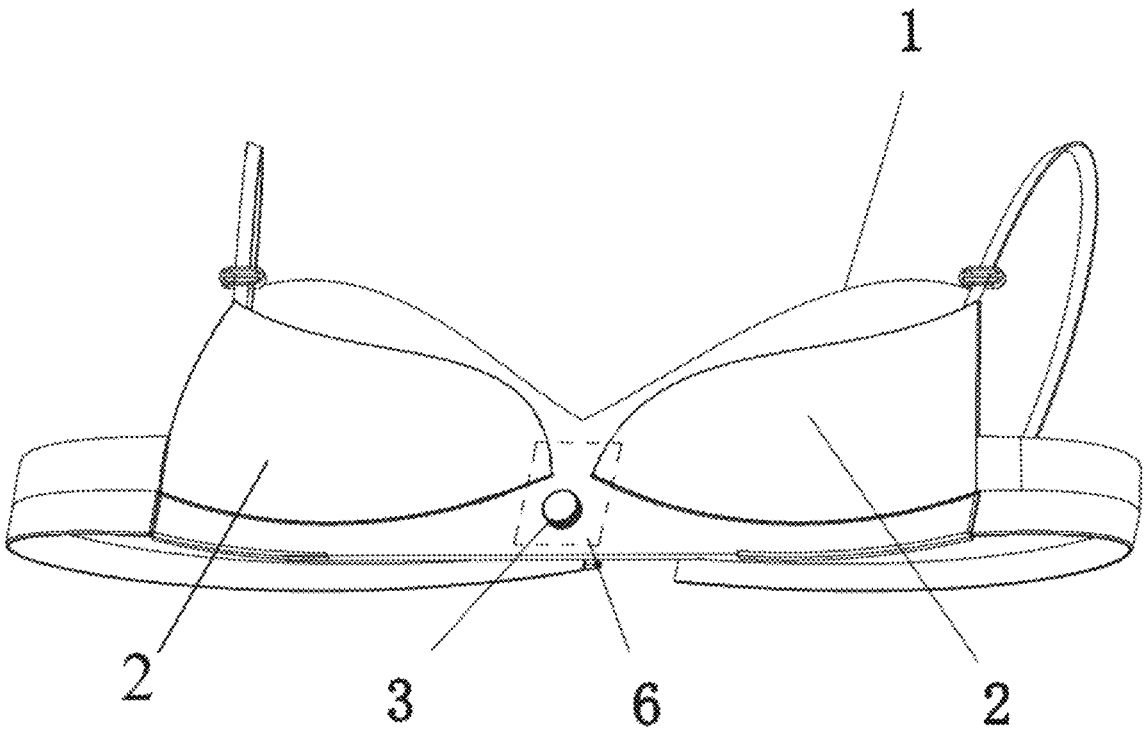
FIG. 1 is the schematic diagram for structure of this invention.

Explanation to drawing sign: underwear 1, cup 2, regulating knob 3, regulating rope 4, rope fixing piece 5, isolating pad 6, fixed baseplate 3-1, winding wheel 3-2, limit shell 3-3, top cover 3-4, fixed groove 3-5, limit clamping slot 3-6, rope traction seat 3-1-1, traction slot 3-1-2, winding section 3-2-1, limit arm 3-2-2, chassis 3-2-3, limit gear 3-3-1, rotating shaft 3-4-1, the first eyelet 3-2-11, the second eyelet 3-2-12, the third eyelet 3-2-13, the fourth eyelet 3-2-14, the first limit arm 3-2-21, the second limit arm 3-2-22, limit edge 3-2-31, the first baffle 3-2-211, the second baffle 3-2-212, the third baffle 3-2-221, the fourth baffle 3-2-222, limit slot 3-4-11, sewn area 5-1.

DESCRIPTION OF THE PREFERRED EMBODIMENTS

Figure 2:
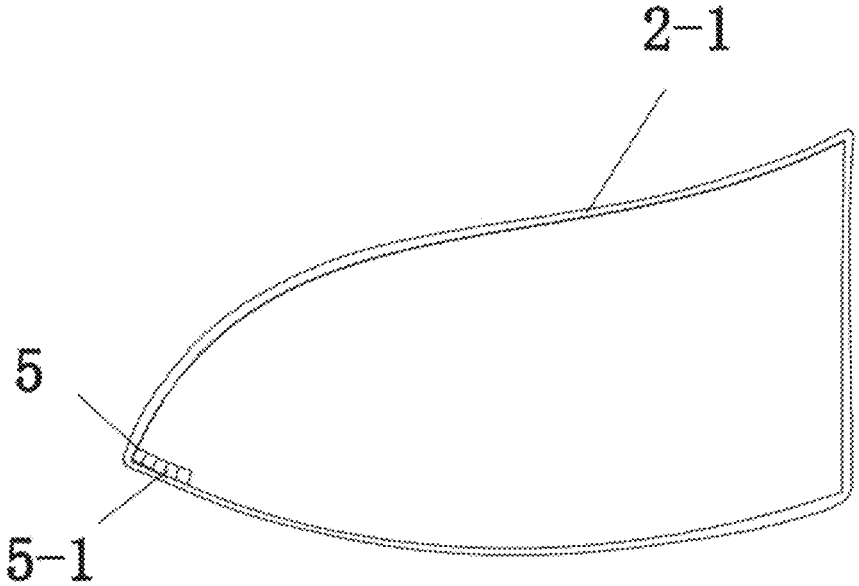
FIG. 2 is the schematic diagram for structure of cup 2 in this invention.
Figure 3:
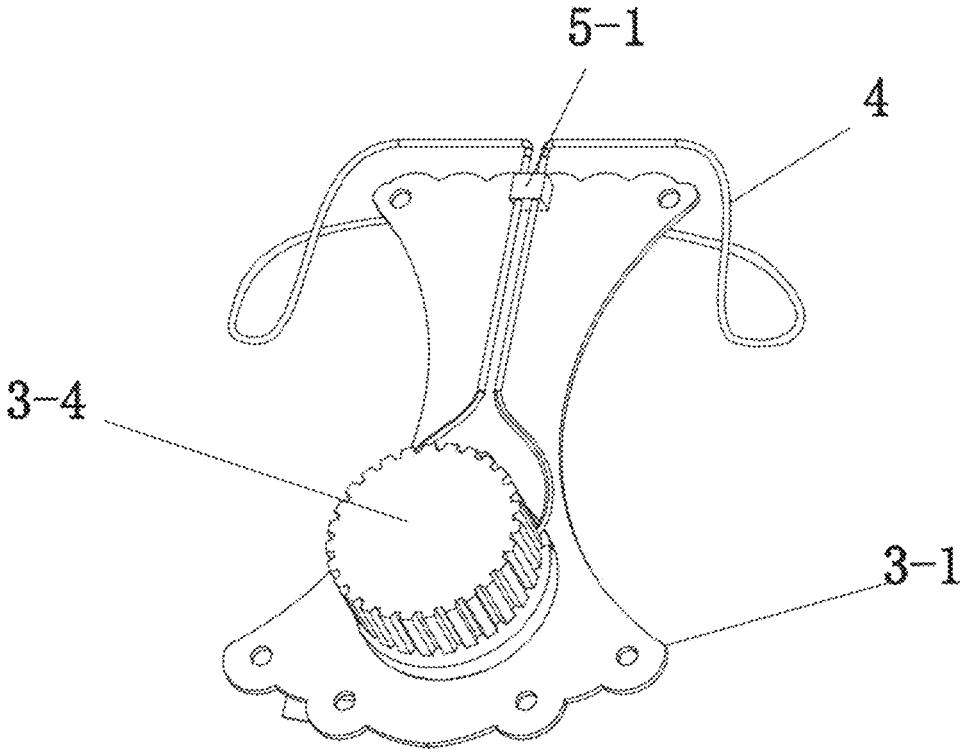
FIG. 3 is the schematic diagram for structure of regulating knob 3 in this invention.
Figure 4:
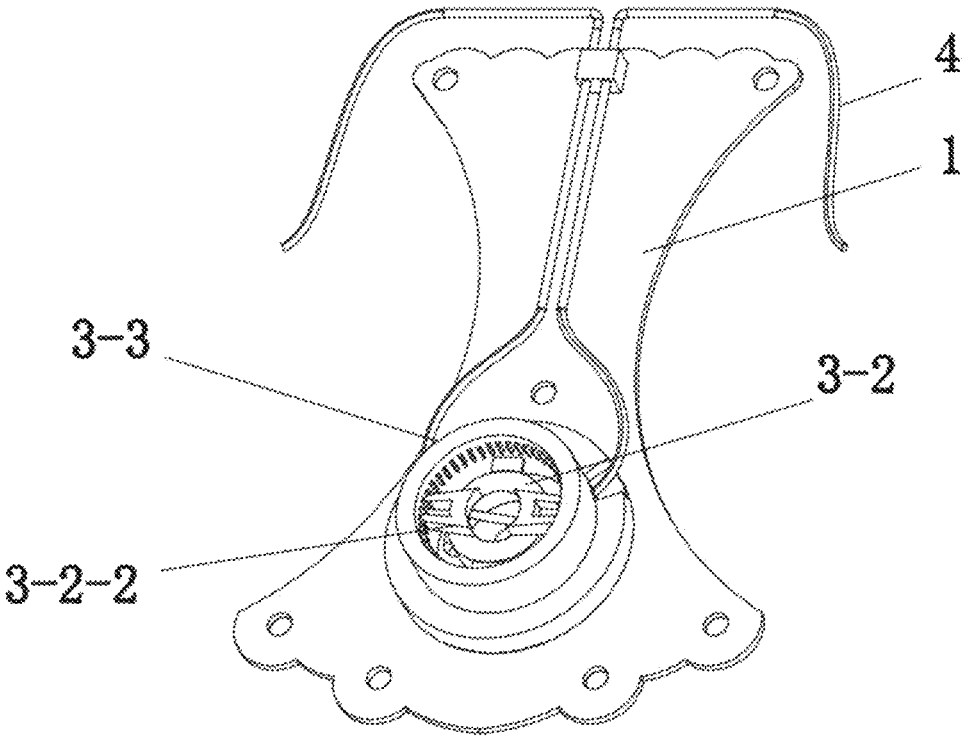
FIG. 4 is the schematic diagram for interior of FIG. 3 except top cover 3-4.
Figure 5:
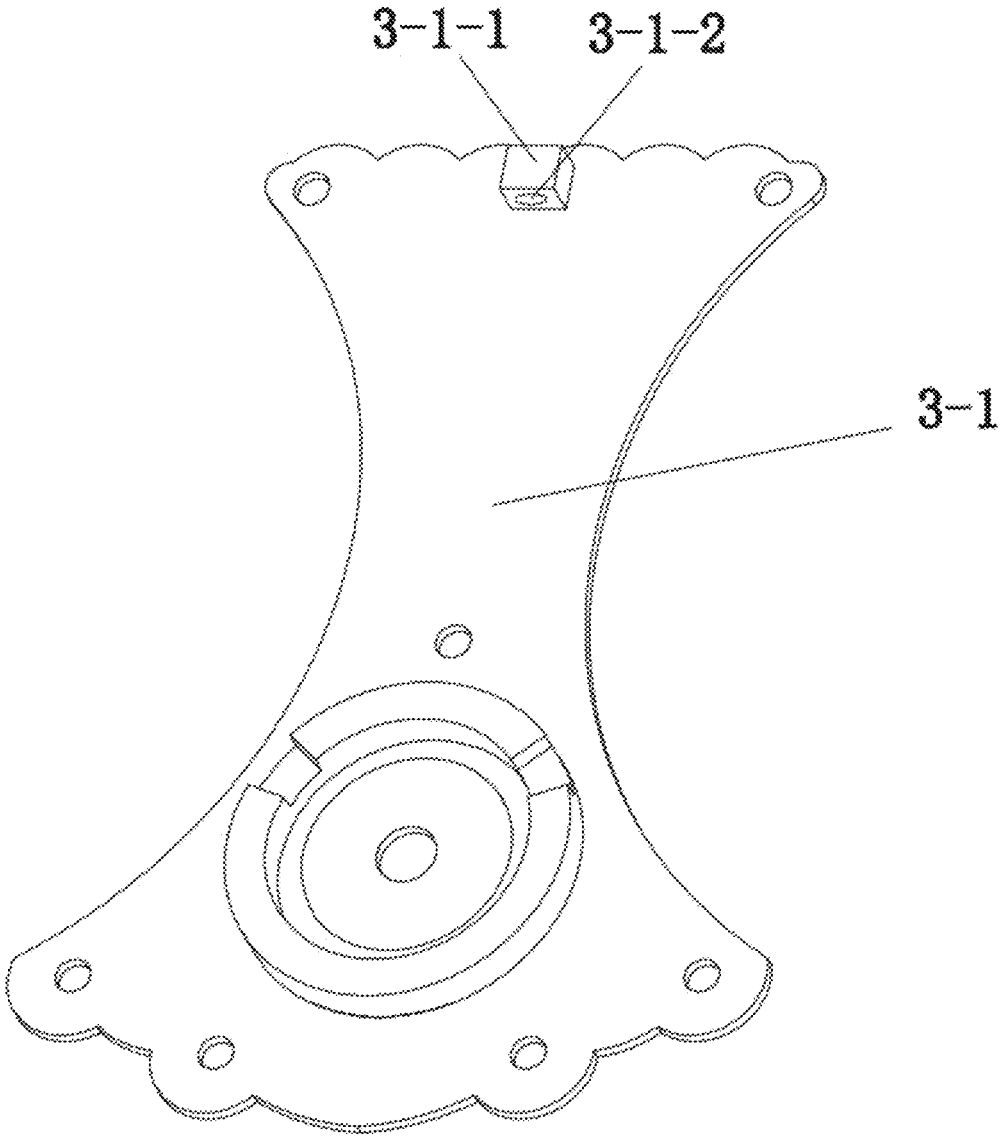
FIG. 5 is the schematic diagram for structure of the fixing baseplate 3-1 in this invention.
Figure 6:
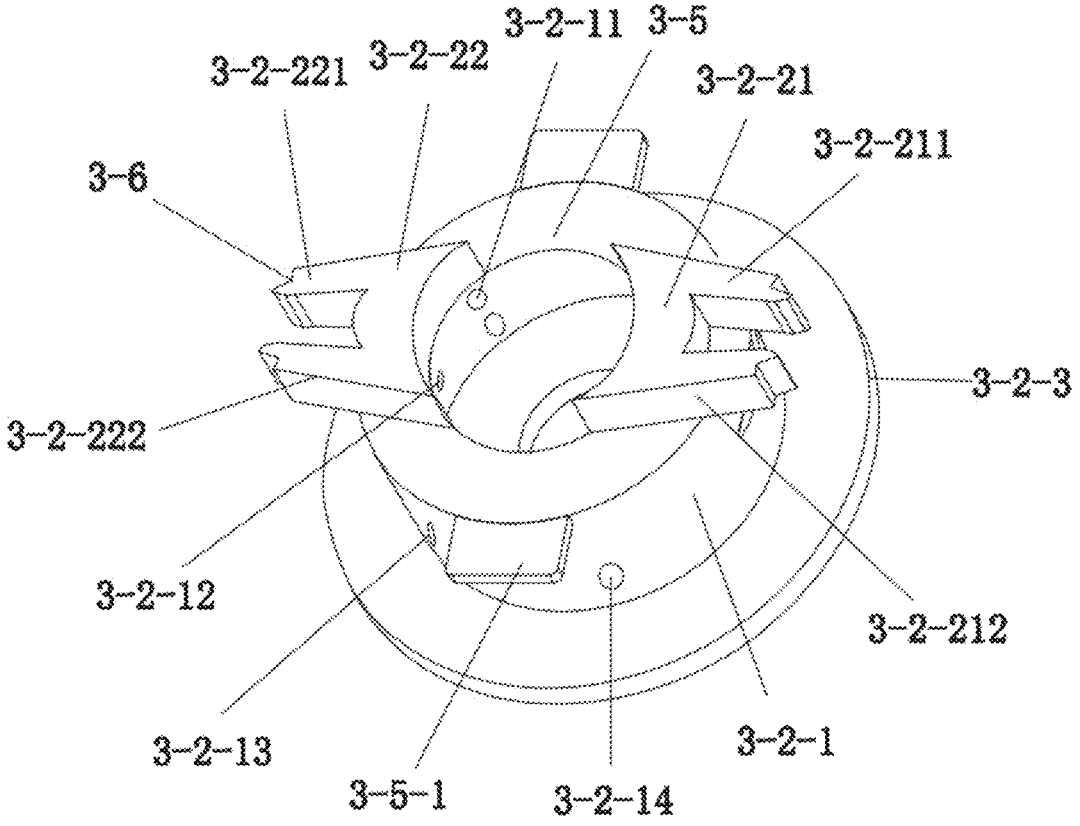
FIG. 6 is the schematic diagram for structure of winding wheel 3-2 in this invention.
Figure 7:
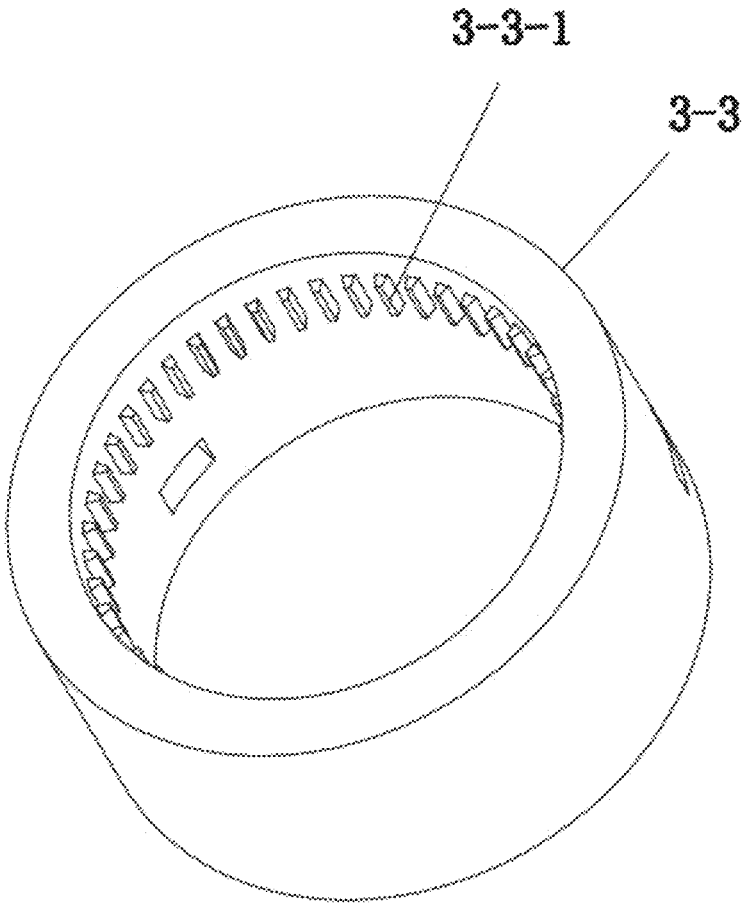
FIG. 7 is the schematic diagram for structure of limit shell 3-3 in this invention.
Figure 8:
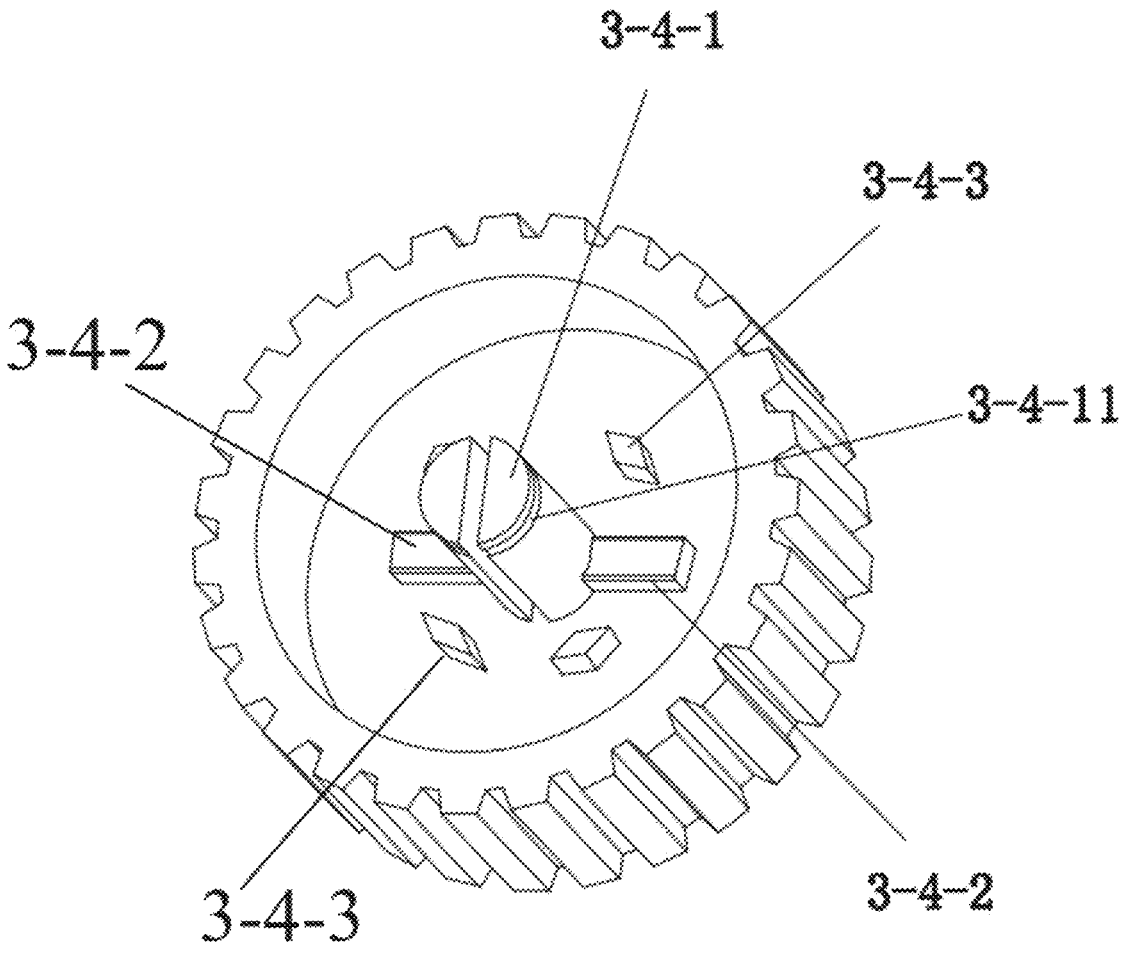
FIG. 8 is the schematic diagram for structure of top cover 3-4 in this invention.
Figure 9:
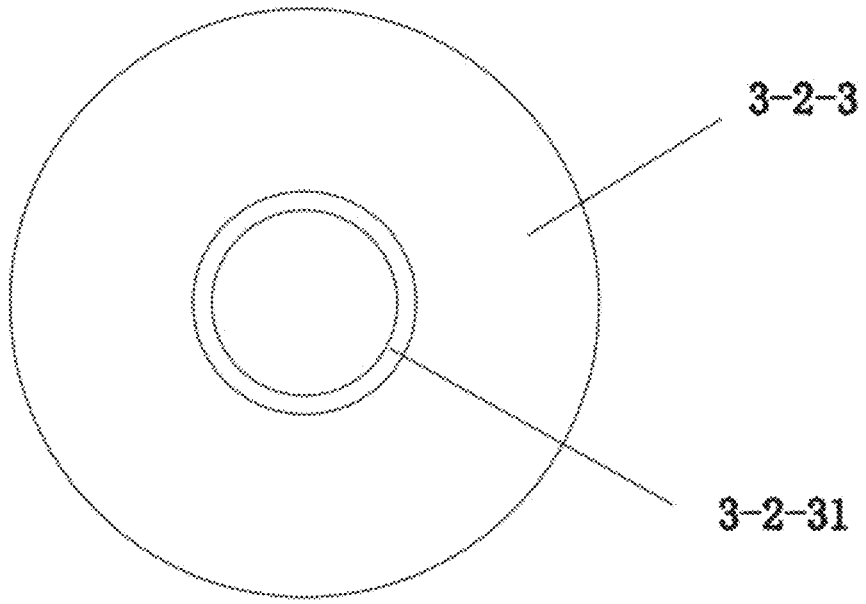
FIG. 9 is the schematic diagram for structure of chassis 3-2-3 in this invention.
Figure 10:
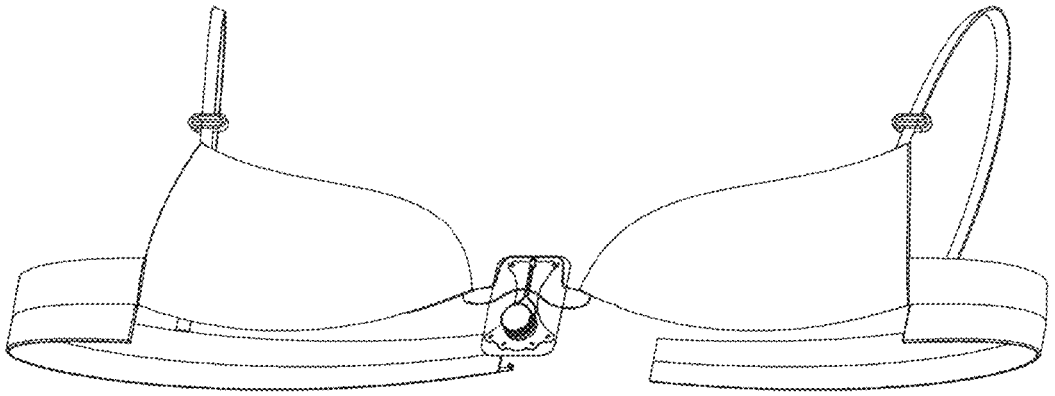
FIG. 10 is the schematic diagram for cup 2 in the non converged state in this invention.
Figure 11:
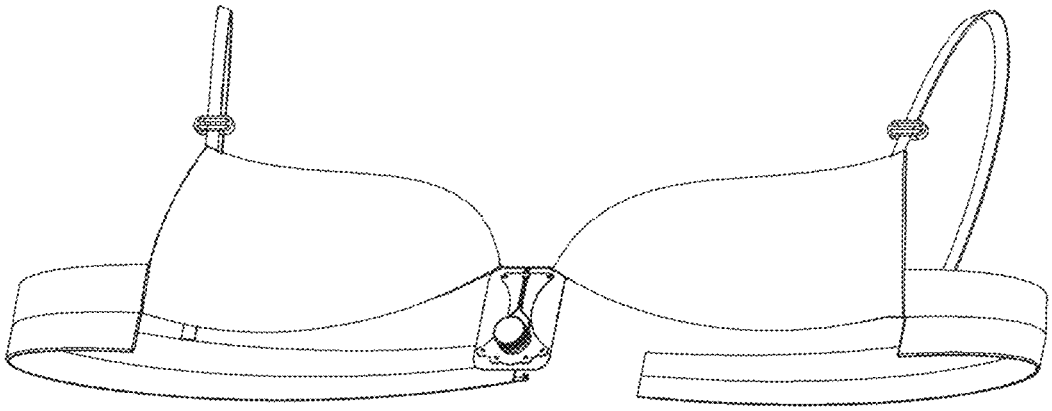
FIG. 11 is the schematic diagram for cup 2 in the converged state in this invention.

As shown in FIG. 1-11, the technical scheme adopted in the description of the preferred embodiments is: it includes underwear 1 and cup 2, cup 2 is symmetrically and movably set on underwear 1, and the rim of the said cup 2 is sewn onto underwear 1 through the elastic fixing edge with narrow side 2-1, but in the structure of traditional cup, cup is directly sewn onto underwear, and in some existing adjustable underwear, only the opening for matching with movement is set, but in the frequent regulating process, since cup is a fixed structure, frequent pulling and moving would damage the fixed part, so in this example, elastic fixing edge with narrow side is set at the cup rim, it is taken as the moving and resetting structure, it not only provides certain space for the movement of cup, but also performs flexible pulling instead of rigid dragging in the frequent regulating process, therefore, it has comparatively good protective effect on underwear, meanwhile, because of the elastic effect of fixed rim, the fitting effect between cup and bosom is better, and the feeling of wearing comfortableness is better;

More concretely, in this example, there is regulating knob 3 below the position corresponding to the center front of underwear 1, there is regulating rope in the regulating knob 3, the regulating rope 4 is in state of closed loop, but in traditional regulating and fixing mechanism, traction and convergence are performed to cup by linked structure, unilateral traction structure could not ensure synchronous regulating effect, when the squeezing strength exerted on one side is excessively big, the circumstance of failed regulation at one side is prone to emergence, as a result, traction and convergence could not be realized, but circular regulating rope is adopted in this example, so as to be connected with cup for fixing, and when the regulating knob is turned, the cup at both sides can be driven concurrently to move and converge inward at the same time, the circumstance of unilateral movement would not occur, and the regulating effect is more obvious;

At the bottom of that side of cup 2 faced with the regulating knob 3, there is rope fixing piece 5, regulating rope 4 is fixed onto the rope fixing piece 5, the traction position of regulating rope 4 is higher than the position corresponding to the low point of the arc end at bottom of cup 2, a segment of rope fixing piece is set on cup for connection with the regulating rope, so that the regulating rope would not directly act on cup, it not only has better effect of traction and stretching, but also prevents damage to cup in long time of regulating process, therefore, the service life is prolonged.

More specifically, there is isolating pad 6 at the position corresponding to the center front of underwear 1, the isolating pad 6 extends to cover to the bottom of underwear 1, the regulating knob 3 is sewn on the isolating pad 6, by setting the isolating pad whose area is greater than that of the regulating knob, foreign body sensation at the time of wearing is reduced, the comfortableness of wearing is enhanced, and the installation and fixing of the regulating knob is facilitated.

More specifically, there is multiple sewing areas 5-1 on the said rope fixing piece 5, and the sewing area 5-1 corresponds to the regulating rope 4, according to the actual dimension, different position of the regulating rope is fixed to different sewing area, so as to reach different tightness, and under the circumstance of setting identical length of regulating rope, it is more convenient to be suitable for underwear of different specification, the applicability is better.

More specifically, the said regulating knob 3 includes fixed baseplate 3-1, winding wheel 3-2, limit shell 3-3 and top cover 3-4, limit shell 3-3 is buckled with the fixed baseplate 3-1, winding wheel 3-2 is set into the limit shell 3-3, top cover 3-4 is set at the top of limit shell 3-3 and is movably connected with the winding wheel 3-2, and in this example, the limit shell fits with the buckle on the fixed baseplate through buckle, so as to realize the installation of limit shell and fixed baseplate, the winding wheel shall firstly be put onto the fixed baseplate before installing, and then it shall be set outside for constraint through the limit shell, meanwhile, the matching of winding wheel and limit shell is the main regulating mode of converging and releasing, and at the time of operating, the winding wheel is turned through the movable connection between the top cover and winding wheel, so as to realize unidirectional rotating and fixing clockwise or counterclockwise.

More specifically, the said winding wheel 3-2 includes winding section 3-2-1, limit arm 3-2-2 and chassis 3-2-3, the winding section 3-2-1 is located on the chassis 3-2-3, the limit arm 3-2-2 is a symmetrical structure that is set on the winding section 3-2-1, there is through hole at the center of chassis 3-2-3, and there is limit edge 3-2-31 that extends inward at the edge of through hole, the center of winding wheel is entirely a hollow structure, the top cover can penetrate the entirety to be connected with the chassis, and rotation of top cover on the winding wheel can be realized;

More concretely, the limit arm in this example is the main unidirectional positioning structure, and the limit arm is a symmetrical structure, so as to realize bilateral synchronous positioning check and release rotation.

More specifically, in order to realize checking and releasing, the structure of the said limit arm 3-2-2 in this example, including the first limit arm 3-2-21 and the second limit arm 3-2-22, are identical, and they are both elastic structure;

That side of the first limit arm 3-2-21 opposite to the second limit arm 3-2-22 is an arc structure, the arc shaped concave surfaces are opposite to form a structure of cylindrical passing through trough, and fixed groove 3-5 is formed at both ends of the opposite part, both arc slot structures do not contact, so structure of fixed groove is formed at both ends, the structure of fixed groove is used for matching with the top cover, so that when the top cover rotates, the winding wheel can be better activated for rotation adjustment;

The bottom of fixed groove 3-5 extends outward to form spacing plate 3-5-1, the spacing plate is used for limiting the regulating rope, so as to prevent the regulating rope from surpassing the winding wheel at the time of tightening up and converging;

The middle part of limit arm is the through slot to extend to the winding section 3-2-1, so as to facilitate the through installation of top cover;

There are the first baffle 3-2-211 and the second baffle 3-2-212 on the first limit arm 3-2-21, and there are the third baffle 3-2-221 and the fourth baffle 3-2-222 on the second limit arm 3-2-22, the first baffle 3-2-211 and the second baffle 3-2-212 are set obliquely and symmetrically in the opposite direction, and the top does not contact, the third baffle 3-2-221 and the fourth baffle 3-2-222 are obliquely and symmetrically set in the opposite direction, and the top does not contact, the baffles that are both obliquely set in the opposite direction in this example form two triangle structure with opening, the opening part can both retreat inward, at the time of rotating the top cover, the mutually opposite two baffles among them can be pressed to retreat synchronously, so as to realize rotation, and the baffles shall reset for clamping and fixing when rotation stops;

Concretely speaking, on top of the said first baffle 3-2-211, second baffle 3-2-212, the third baffle 3-2-221 and the fourth baffle 3-2-222, there is limit clamping slot 3-6, the length of the inner side of the limit clamping slot 3-6 is greater than the length of outer side, the short side at the internal side of the limit clamping slot does not have the effect of clamping, the long side is the fixed side for clamping, it supports unidirectional clamping and fixing, the two baffles that are mutually opposite, i.e., the first baffle and the third baffle, are baffles that act synchronously, the second baffle and the fourth baffle are baffles that act synchronously, they are clamped and fixed in two directions, that can effectively prevent accidental reverse rotation for regulating the rotation, so as to ensure the converging effect of cup.

More specifically, on the said winding section 3-2-1, there are the first eyelet 3-2-11, the second eyelet 3-2-12, the third eyelet 3-2-13 and the fourth eyelet 3-2-14, the first eyelet 3-2-11 penetrates the winding section 3-2-1 and is perpendicular to the limit arm 3-2-2, and by the central point in the opening direction of the limit arm 3-2-2 as the center of symmetry, the second eyelet 3-2-12 is set symmetrically with the first eyelet 3-2-11, and by the central point in the opening direction of the fixed slot 3-5 of the limit arm 3-2-2 as the center of symmetry, the third eyelet 3-2-13 and the fourth eyelet 3-2-14 are set symmetrically, and the first eyelet 3-2-11 and the second eyelet 3-2-12 are set above the third eyelet 3-2-13 and the fourth eyelet 3-2-14, the four groups of eyelets in this example are set to both be mutually and spatially perpendicular, and the first and second eyelets are set above the third and the fourth eyelets, among them, the first and the second eyelets are selectively used, only one place needs to be used, setting of two places facilitates use at random one side, and assembling is more convenient;

At the time of rope threading, thread one end of the regulating rope into the first eyelet or the second eyelet, the lead-out end shall be threaded in from the rear end of the third eyelet, and it shall be threaded out from its front end, the other end of the regulating rope shall be threaded in from the rear end of the fourth eyelet, and it shall be threaded out from the front end, then the two free ends shall be connected and fixed, by the setting of multiple groups of eyelets, the direction of exerting force to the regulating rope in the rotation process is not horizontal direction, that can prevent loosening of the regulating rope along the hole of threading through in the regulating or releasing process, the feeling of fastening at the time of regulating is better, but in the traditional structure, the winding wheel was mostly one structure of through hole, the regulating rope would be directly threaded into one or two through holes, the direction of exerting force at the time of rotation is almost the horizontal direction, therefore, the regulating rope is prone to movement in the through hole, the feeling of fastening is relatively poor, since the fastening effect is not good, there might be more friction between the regulating rope and the winding wheel, as a result, the service life of regulating rope is not long, and the experience of using feel is affected.

More specifically, the said fixed baseplate 3-1 is far from one side of the winding wheel 3-2 and extends forward, there is rope traction seat 3-1-1 at the top of the extension segment, there is traction slot 3-1-2 on the rope traction seat 3-1-1, the fixed plate in this example is an extensional structure, regulating knob is installed for the main body, and it is fixed at the position below the center front of underwear, the top is an extension plate structure, which is used for performing position leading and limiting to the regulating rope, after the regulating rope is threaded through the traction slot, it is reversed and a knot is made, so that the regulating rope would not become loose in the traction slot, and fixing of the fixed baseplate is finished, the position of the rope traction seat is located at the middle upper part of center front, it is higher than the position corresponding to the low point of the arc bottom of cup, therefore, when the regulating knob is turned, the regulating rope would perform traction and convergence to the cup bottom from the upper direction, so that effect of lifting upward is achieved and the effect of convergence is better.

More specifically, there is limit gear 3-3-1 at the top of inner wall of the said limit shell 3-3, one side of the limit gear 3-3-1 matches with the limit clamping slot 3-6, the limit clamping slot in this example is set as a structure of long and short sides, among them, the long side contacts the side wall of the limit gear, so that the limit shell would not rotate because of constraint, and when the mutually opposite baffles are pressed concurrently, the constraint by the long side of baffle to the limit gear at those two parts is relieved, the limit gear can push the long side of the other two baffles to rotate, the design of long and short sides is not only simple in structure, but also has better unidirectional clamping effect, since the opposite baffles at both sides are clamped concurrently, and the baffle and limit gear would not be easily damaged.

More specifically, there is rotation shaft 3-4-1 at the bottom center of the said top cover 3-4, the rotation shaft 3-4-1 is a symmetrical semi-cylindrical structure, and there is limit slot 3-4-11 at the terminal of rotation shaft 3-4-1, rotation shaft 3-4-1 penetrates the winding wheel 3-2, and it is movably connected with the fixed baseplate 3-1 through the mating of limit slot 3-4-11 and limit edge 3-2-31, split structure is set for the rotation shaft in this example, the connection with chassis and detachment from it are more convenient, the end of limit slot is squeezed at the time of connecting, it entirely penetrates through the winding wheel, and when the limit slot reaches the position of limit edge, the limit edge is buckled into the limit slot to finish fixing, and at the time of detaching, only pressing the rotation shaft once again is needed, the top cover can be taken out, the structure is simple and the assembly/disassembly is easy;

There is fixed block 3-4-2 at both sides of the rotation shaft 3-4-1, the fixed block 3-4-2 matches with the fixed slot 3-5, and the width of the fixed block is less than the width of the fixed slot, so that the fixed block can move in the fixed slot within a small scope;

There is push block 3-4-3 that is symmetrically set at both sides of fixed block 3-4-2, the push block 3-4-3 is set obliquely, the declivity matches with the limit arm 3-2-2, there are four push blocks in this example, each push block corresponds to one baffle, and the contact surface between push block and baffle is set to mutually match, since the volume of the fixed block is set as being less than the width of the fixed slot, the push block has enough travel to perform compression release to baffle, meanwhile, that is the constraint to the compressed travel of baffle, and damage of baffle caused by excessively great travel is prevented.

Operational principle of this invention: the regulating knob 3 is set below the position corresponding to the center front of underwear 1, the extended part of fixed baseplate 3-1 for the regulating knob 3 is set upward at the position of center front, and the rope traction seat 3-1-1 is higher than the position corresponding to the low point of the arc end at the bottom of cup 2, so that when the regulating rope 4 is threaded out of the traction slot 3-1-1, its position is likewise higher than the position corresponding to the low point of the arc end at the bottom of cup 2, rightward rotation meaning convergence and leftward rotation meaning loosening are taken as examples for illustration, when the top cover 3-4 is turned rightward (rotation clockwise), two push blocks 3-4-3 respectively compress the said first baffle 3-2-211 and the third baffle 3-2-221 to retreat, as a result, the limit clamping slot 3-6 is separated from the limit gear 3-3-1, but since the short side does not contact the limit gear 3-3-1, for the limit clamping slot 3-6 of the second baffle 3-2-212 and the fourth baffle 3-2-222, when the top cover 3-4 continues to be turned clockwise, the winding wheel 3-2 would be driven to synchronously rotate clockwise, the regulating rope 4 is further driven to be twined clockwise onto the winding section 3-2-1, and it would not move at random because of the constraint of the spacing plate 3-5-1, the regulating rope 4 would drive the rope fixing piece 5 concurrently to move in the opposite direction, cup 2 would be driven to be tightened inward, and since the traction position of the regulating rope 4 is higher than the bottom of cup 2, cup 2 would move by the manner of pulling at the time of convergence, when the top cover 3-4 is released, the push block 3-4-3 stops compressing the first baffle 3-2-211 and the third baffle 3-2-221, the long side of the limit clamping slot 3-6 for the first baffle 3-2-211 and the third baffle 3-2-221 tightly contacts the limit gear 3-3-1, so as to realize fixing, and when the top cover 3-4 is turned counterclockwise, the other two push blocks 3-4-3 would respectively compress the second baffle 3-2-212 and the fourth baffle 3-2-222, the limit clamping slot 3-6 on it is separated from the limit gear 3-3-1, similarly, since the short side of the limit clamping slot 3-6 for the first baffle 3-2-211 and the third baffle 3-2-221 does not contact the limit gear 3-3-1, it can rotate smoothly, the regulating rope 4 is released to further loosen the constraint to cup 2, it would gradually reset under the effect of elastic fixing edge 2-1, and since elastic fixing edge 2-1 is set, not only space is provided for the displacement of cup 2, but also relatively good elastic resilience is provided, bra would not be prone to deformation in wearing, and it fits better and is more comfortable for wearing.

The above is only to illustrate the technical scheme instead of limitation for this invention, and for other modification or equivalent substitution to the technical scheme of this invention by ordinary technical personnel in this domain, so long as it is not off the spirit and scope of the technical scheme of this invention, it should be covered by the scope of claim of this invention.

The invention claimed is:

1. A push-up underwear, comprising cups, the cups are symmetrically and movably set on the underwear, a regulating knob is provided at a position corresponding to a position below a center front of the underwear, a regulating rope is provided in the regulating knob, the regulating rope is in a state of a closed loop, a rope fixing piece is provided at a bottom of the cups faced with the regulating knob, the regulating rope is fixed onto the rope fixing piece, a traction position of the regulating rope is higher than a position corresponding to a low point of an arc end at the bottom of the cups, and an edge of the cups is sewn onto the underwear through an elastic fixing edge.

2. The push-up underwear according to claim 1, wherein, an isolating pad is provided at a position corresponding to the center front of the underwear, the isolating pad extends to cover to the bottom of the underwear, and the regulating knob is sewn onto the isolating pad.

3. The push-up underwear according to claim 1, wherein, a multiple sewn areas are provided on the rope fixing piece, and a sewing area corresponds to the regulating rope.

4. The push-up underwear according to claim 1, wherein, the regulating knob comprises a fixed baseplate, a winding wheel, and a limit shell, and a top cover, the limit shell is buckled with the fixed baseplate, the winding wheel is set within the limit shell, and the top cover is set at a top of the limit shell and is movably connected with the winding wheel.

5. The push-up underwear according to claim 4, wherein, the winding wheel comprises a winding section, a limit arm and a chassis, the winding section is located on the chassis, the limit arm is a symmetrical structure that is set on the winding section, a through hole is defined at a center of the chassis, and a limit edge extends inward along a rim of the through hole.

6. The push-up underwear according to claim 5, wherein, the limit arm comprises the first limit arm and the second limit arm, a side of the first limit arm opposite to the second limit arm is an arc structure, a fixed groove is formed at both ends, a bottom of the fixed groove extends outward to form a spacing plate, a middle part is a through slot that extends to the winding section, a first baffle and a second baffle are provided on the first limit arm, and a third baffle and a fourth baffle are provided on the second limit arm, the first baffle and the second baffle are set obliquely and symmetrically in an opposite direction, the third baffle and the fourth baffle are obliquely and symmetrically set, a limit clamping slot is provided on the first baffle, the second baffle, the third baffle and the fourth baffle, and a length of an inner side of the limit clamping slot is greater than a length of an outer side.

7. The push-up underwear according to claim 5, wherein, a first eyelet, a second eyelet, a third eyelet and a fourth eyelet are provided on the winding section, the first eyelet penetrates the winding section and perpendicular to the limit arm, and with a central point in an opening direction of the limit arm is acted as a center of symmetry, the second eyelet is set symmetrically with the first eyelet, and with the central point in the opening direction of the limit clamping slot of the limit arm is acted as the center of symmetry, the third eyelet and the fourth eyelet are set symmetrically, the first eyelet and the second eyelet are set above the third eyelet and the fourth eyelet.

8. The push-up underwear according to claim 4, wherein, the said fixed baseplate is far from one side of the winding wheel and extends forward, a rope traction seat is provided at a top of an extension segment, and a traction slot is provided on the rope traction seat.

9. The push-up underwear according to claim 4, wherein, a limit gear is provided on a top of an inner wall of the limit shell, and one side of the limit gear matches with the limit clamping slot.

10. The push-up underwear according to claim 4, wherein, a rotating shaft is provided at a bottom center of the top cover, the rotating shaft is a symmetrical semi-cylindrical structure, a limit slot is provided at a terminal of the rotating shaft, the rotating shaft penetrates the winding wheel and is movably connected with the fixed baseplate through the mating of the limit slot and the limit edge, fixed blocks are provided at both sides of the rotating shaft, the fixed blocks match with the fixed slot, push blocks are symmetrically set at both sides of the fixed blocks, the push blocks are obliquely set, and obclivity matches with the limit arm.

* * * * *